US008052477B1

(12) United States Patent
Ko

(10) Patent No.: US 8,052,477 B1
(45) Date of Patent: Nov. 8, 2011

(54) RECEPTACLE CONNECTOR FOR A CABLE

(75) Inventor: Wen-Chih Ko, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 0 days.

(21) Appl. No.: 12/827,083

(22) Filed: Jun. 30, 2010

(30) Foreign Application Priority Data

Apr. 21, 2010 (TW) ..... 99207258 U

(51) Int. Cl.
*H01R 24/00* (2011.01)

(52) U.S. Cl. ..... 439/660

(58) Field of Classification Search ..... 439/660, 439/494, 499, 497, 492, 874
See application file for complete search history.

(56) References Cited

U.S. PATENT DOCUMENTS 6,454,605 B1 * 9/2002 Bassler et al. ..... 439/607.23
7,422,488 B1 * 9/2008 Wu ..... 439/676
7,534,143 B1 * 5/2009 Tsao et al. ..... 439/607.41
2005/0255759 A1 * 11/2005 Lai et al. ..... 439/874

* cited by examiner

*Primary Examiner* — Tulsidas C Patel
*Assistant Examiner* — Harshad Patel
(74) *Attorney, Agent, or Firm* — C. G. Mersereau; Nikolai & Mersereau, P.A.

(57) ABSTRACT

A receptacle connector for a cable has an insulating housing, multiple first terminals, multiple second terminals and a shell. The first terminals are mounted on the insulating housing and each first terminal has a first soldering cup formed on the first terminal and extending backward out of the insulating housing. The second terminals are mounted on the insulating housing, are capable of cooperating with the first terminals to implement USB 3.0 protocol and each second terminal has a second soldering cup formed on the second terminal and extending backward out of the rear end of the insulating housing. The shell covers the insulating housing, the first terminals and the second terminals. The receptacle connector may be mounted one end of the cable so that cable is used for high speed data transmission between different electronic devices.

6 Claims, 10 Drawing Sheets

RECEPTACLE CONNECTOR FOR A CABLE

BACKGROUND OF THE INVENTION

1. Field of the Invention

The present invention relates to a connector, and more particularly to a receptacle connector for a cable, is capable of implementing USB 3.0 protocol and is mounted on the cable for high frequency signal transmission between electronic devices.

2. Description of Related Art

Conventional Universal Serial Bus (USB) 2.0 connectors are used popularly in various electronic devices. Most of computer peripherals are equipped with USB connectors. Because electronic devices are constantly developed to increase transmission speed thereof, the USB 2.0 protocol does not meet the current transmission speed requirement of new electronic devices. Therefore, the USB Implementers Forum sets forth new USB 3.0 protocol for higher data transmission speed.

The USB 3.0 protocol is compatible with the USB 2.0 protocol and provides theoretical 5 Gbps of data transmission speed.

Furthermore, different electronic devices such desktops and laptops are connected to each other by cables for data transmission. A conventional cable has two ends, a plug connector and a receptacle connector. The plug and receptacle connectors are mounted respectively in the ends and may be connected to different electronic devices.

However, current USB 3.0 receptacle connectors are only mounted on printed circuit boards and are not designed for cables so that conventional cables without USB 3.0 receptacle connectors cannot provide sufficient bandwidth for high speed data transmission between different electronic devices.

To overcome the shortcomings, the present invention provides a receptacle for a cable to mitigate or obviate the aforementioned problems.

SUMMARY OF THE INVENTION

The main objective of the invention is to provide a receptacle connector for a cable, is capable of implementing USB 3.0 protocol and is mounted on the cable for high frequency signal transmission between electronic devices.

A receptacle connector for a cable in accordance with the present invention has an insulating housing, multiple first terminals, multiple second terminals and a shell. The first terminals are mounted on the insulating housing and each first terminal has a first soldering cup formed on the first terminal and extending backward out of the insulating housing. The second terminals are mounted on the insulating housing, are capable of cooperating with the first terminals to implement USB 3.0 protocol and each second terminal has a second soldering cup formed on the second terminal and extending backward out of the rear end of the insulating housing. The shell covers the insulating housing, the first terminals and the second terminals. The receptacle connector may be mounted one end of the cable so that cable is used for high speed data transmission between different electronic devices.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
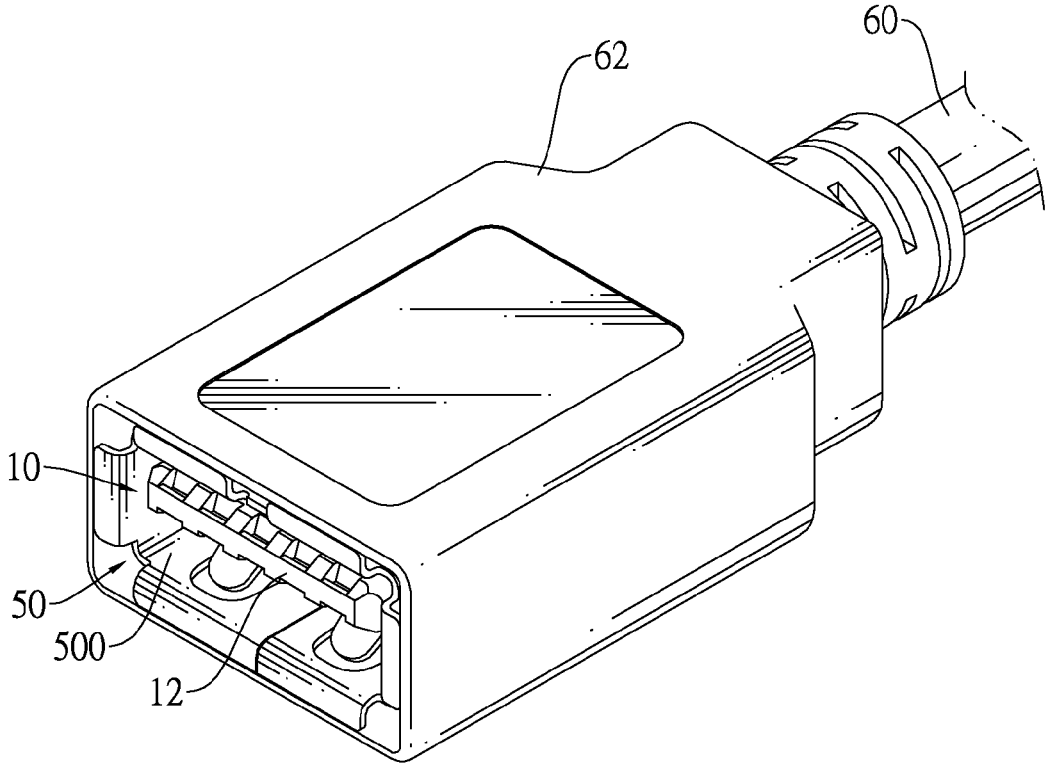
FIG. 1 is a perspective view of a receptacle connector in accordance with present invention mounted on one end of a cable.
Figure 2:
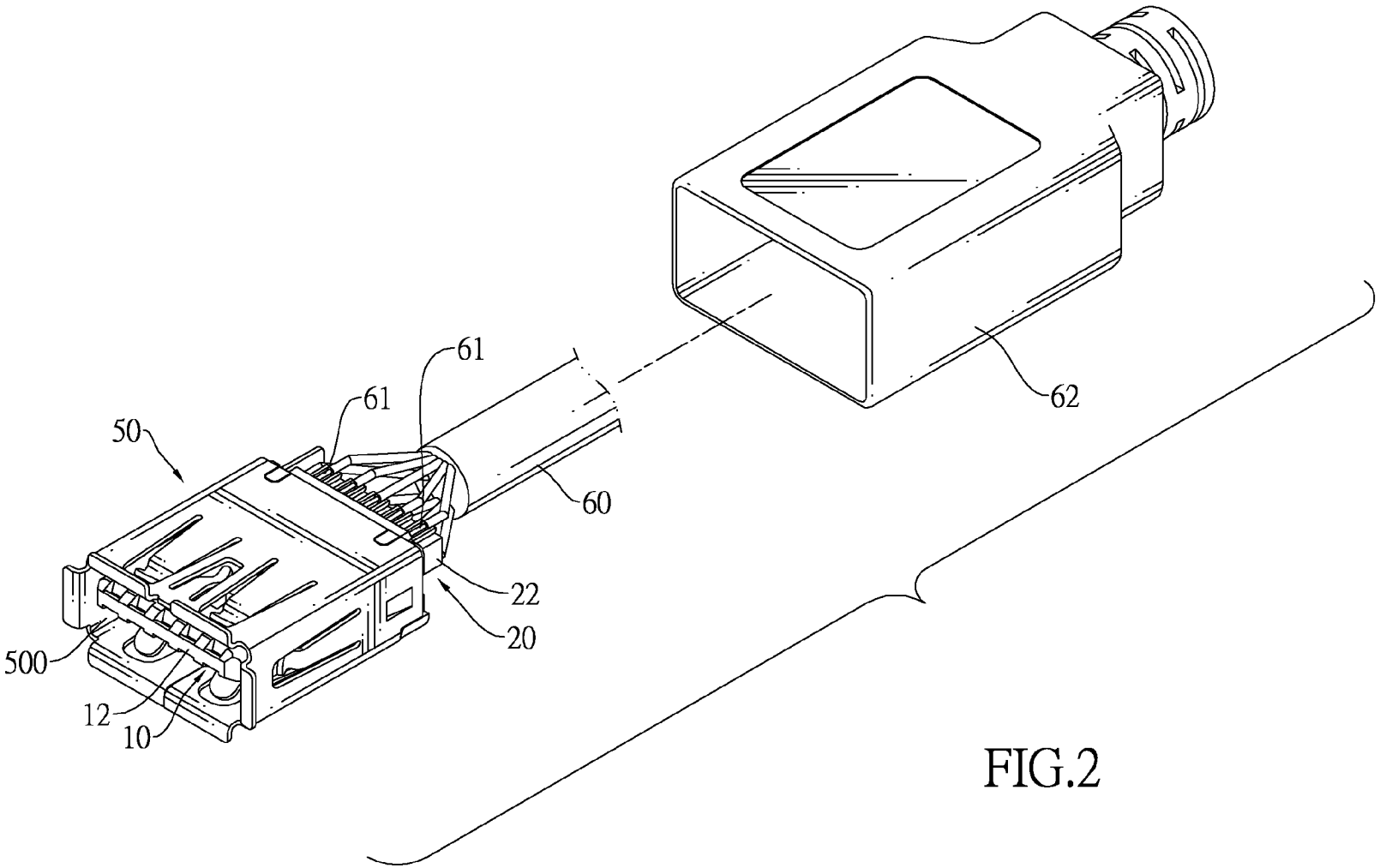
FIG. 2 is a partially exploded perspective view of the receptacle connector and cable in FIG. 1.
Figure 3:
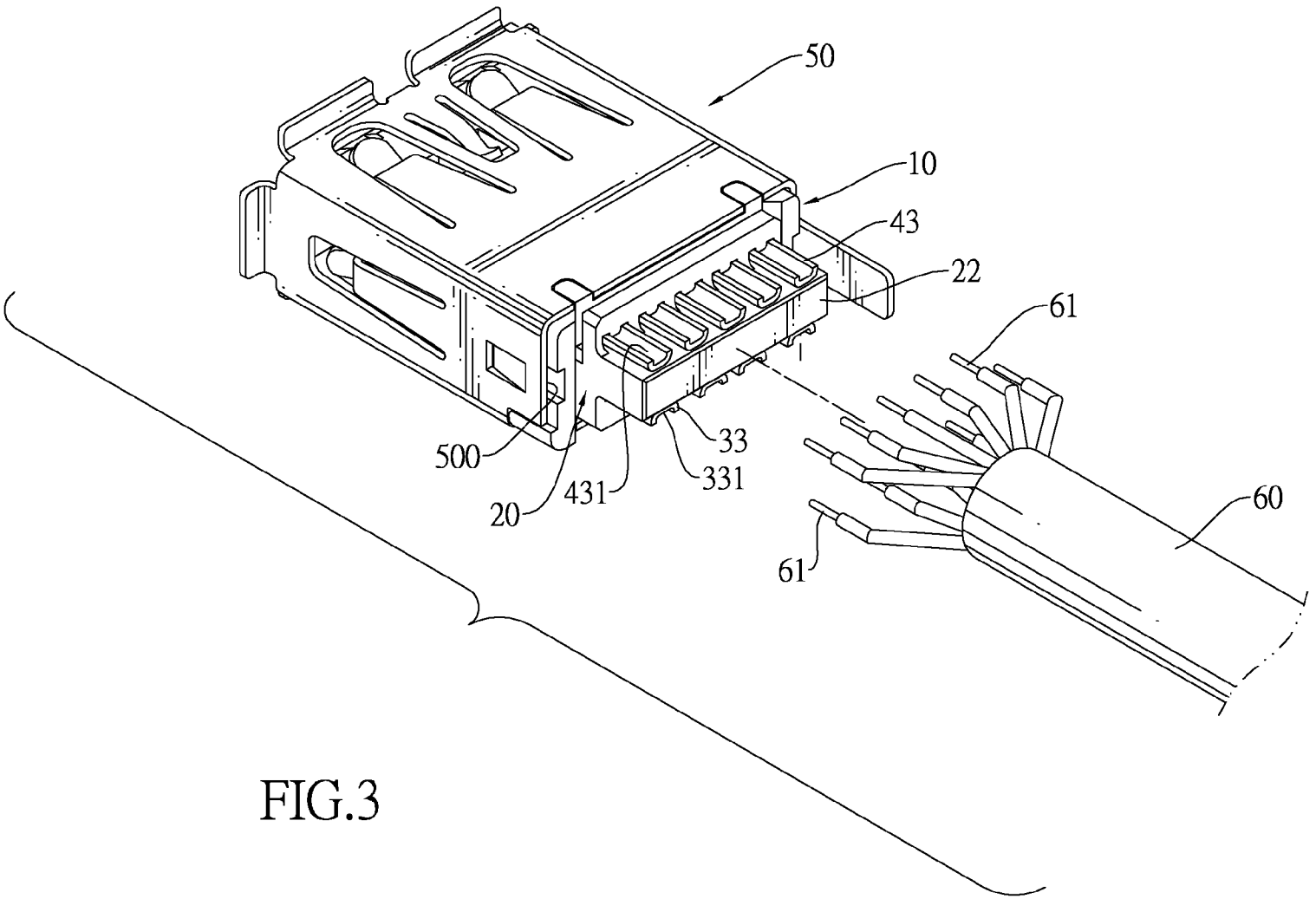
FIG. 3 is a partially exploded perspective view of the receptacle connector and cable in FIG. 2 omitting the sheath.
Figure 4:
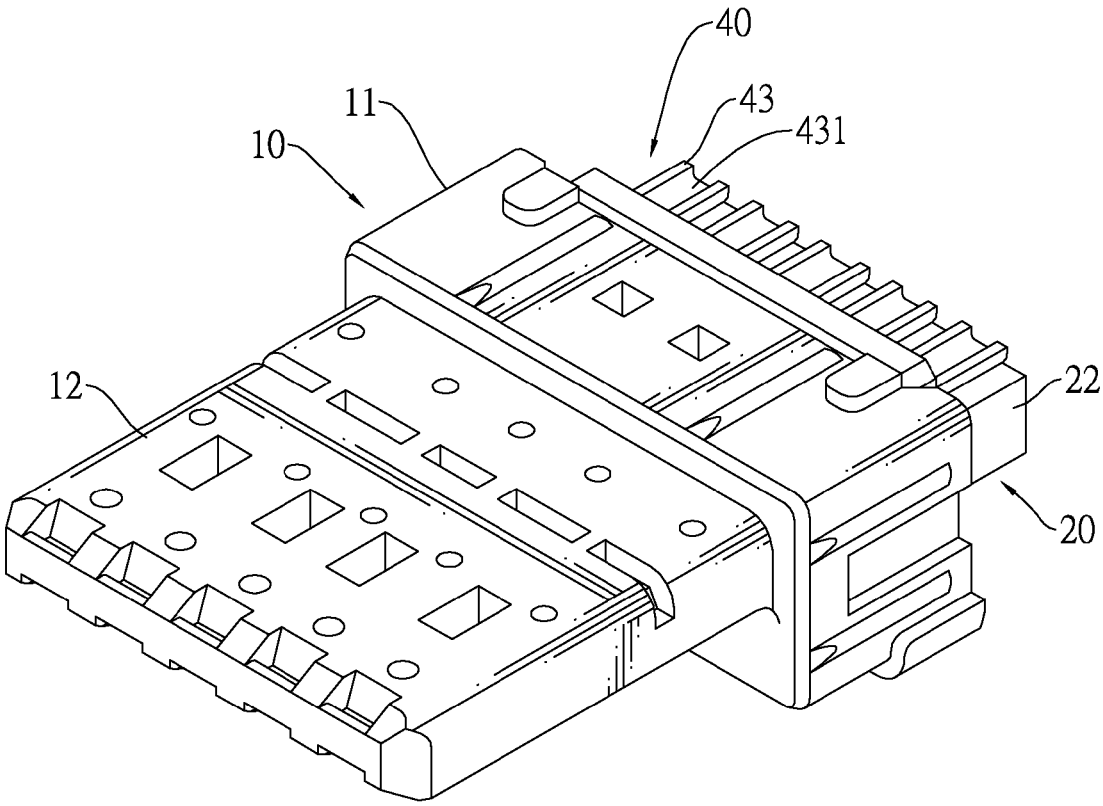
FIG. 4 is a front perspective view of the receptacle connector in FIG. 3 omitting the shell.
Figure 5:
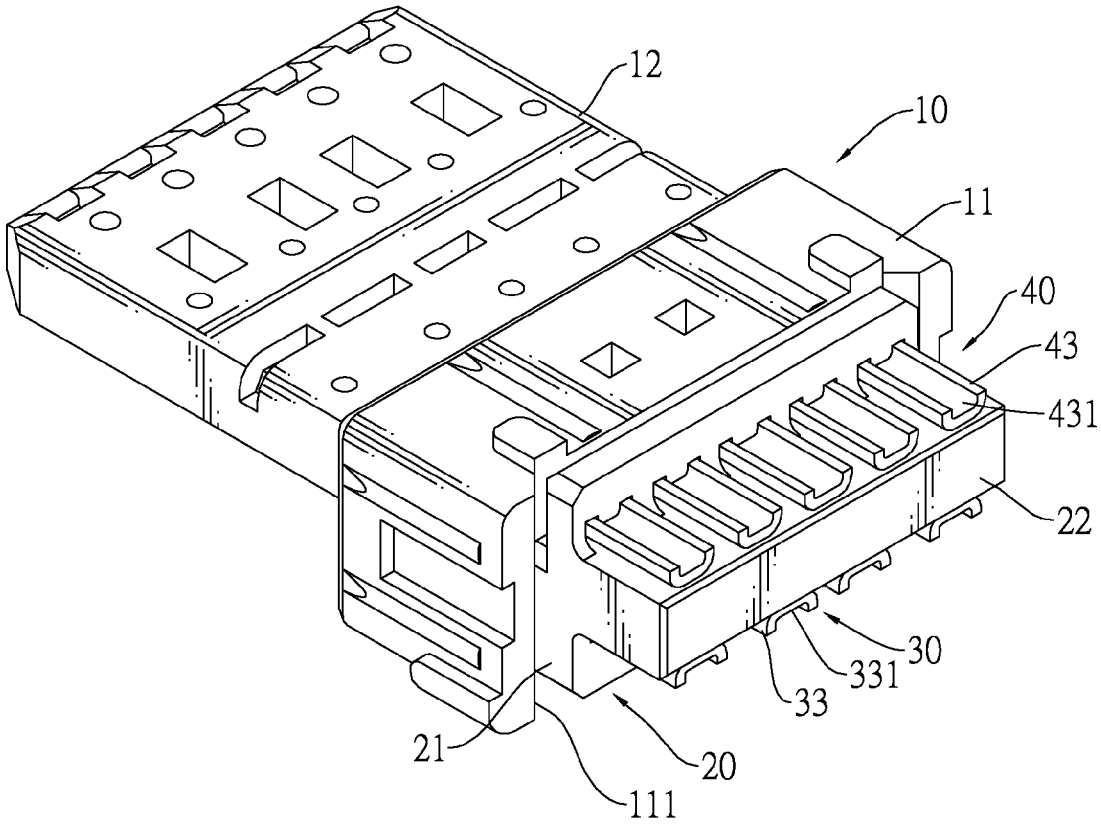
FIG. 5 is a rear perspective view of the receptacle connector in FIG. 3 omitting the shell.
Figure 6:
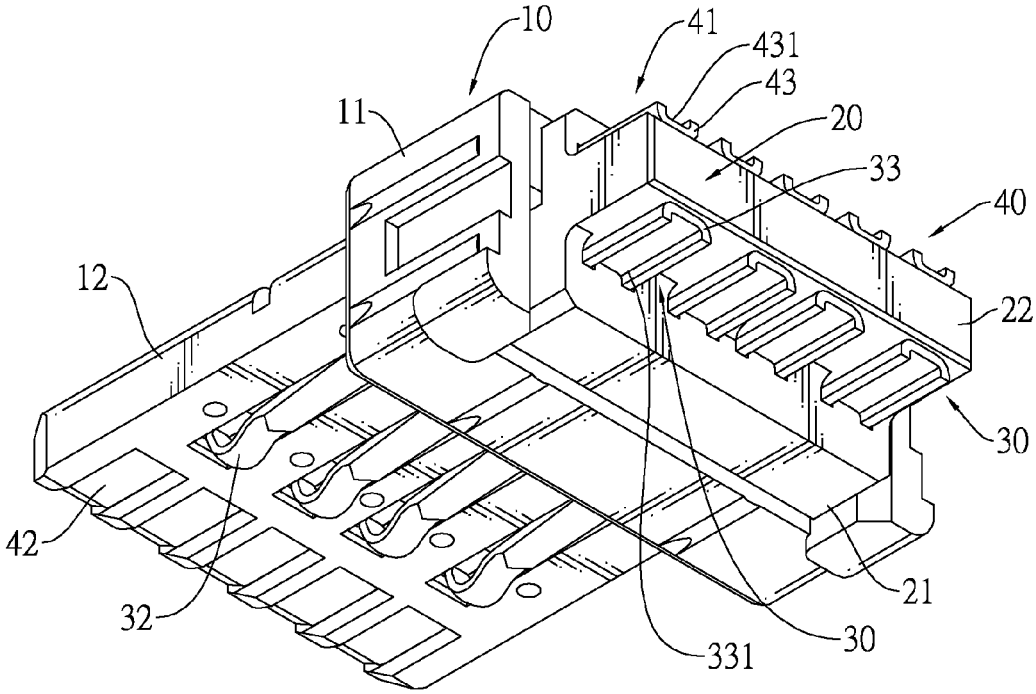
FIG. 6 is a bottom perspective view of the receptacle connector in FIG. 3 omitting the shell.
Figure 7:
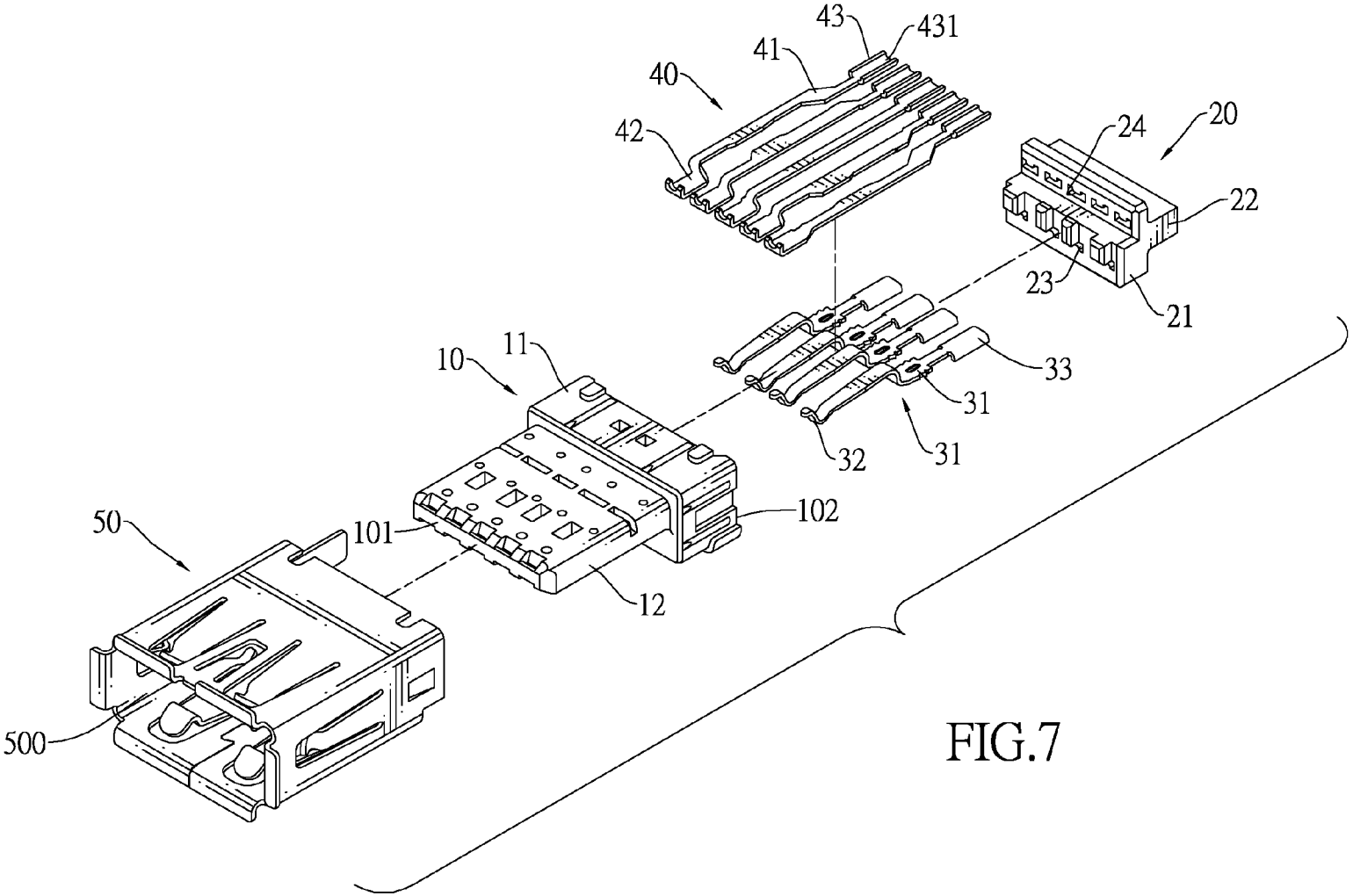
FIG. 7 is an exploded front perspective view of the receptacle connector in FIG. 2.
Figure 8:
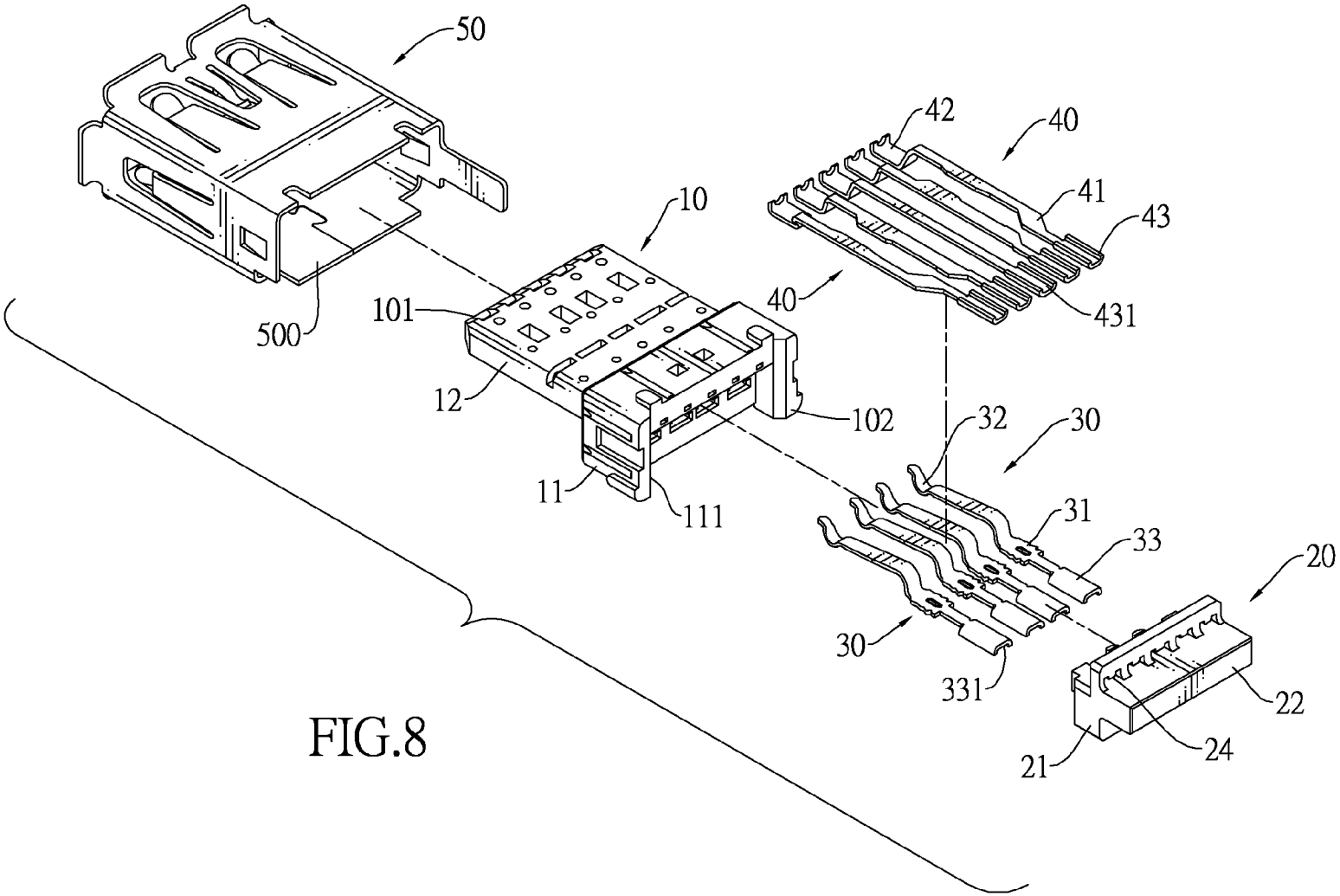
FIG. 8 is an exploded rear perspective view of the receptacle connector in FIG. 2.
Figure 9:
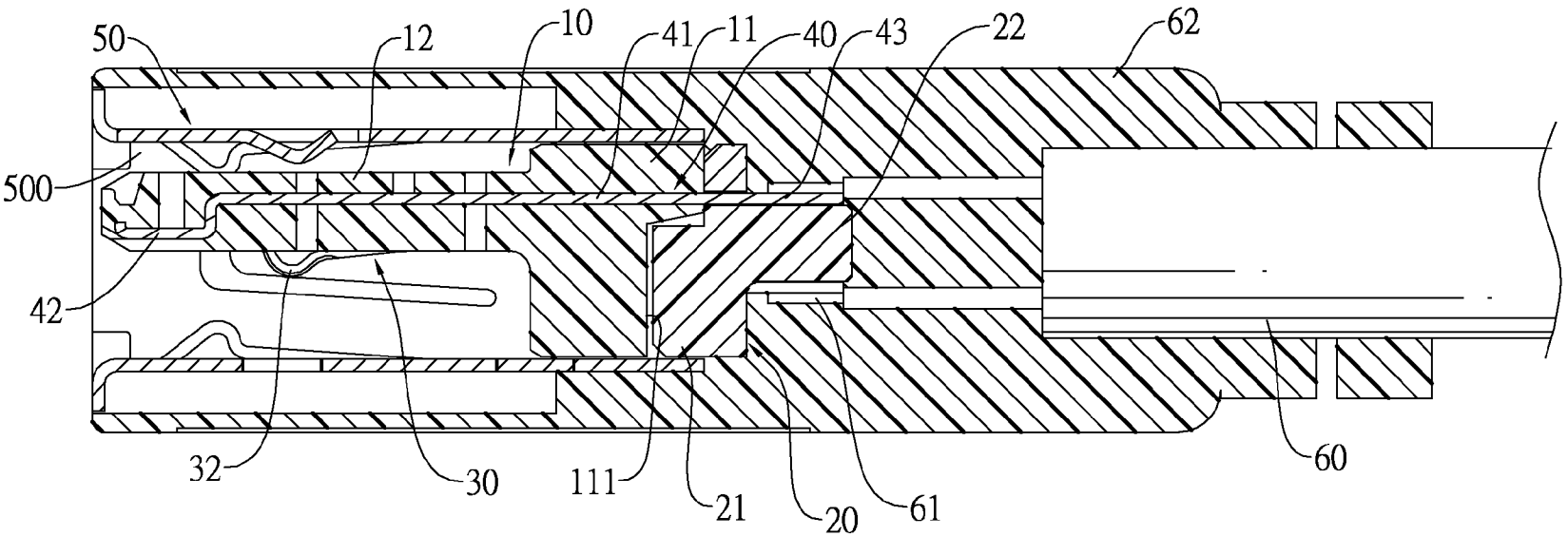
FIG. 9 is a cross sectional side view of the receptacle connector and the cable in FIG. 1.
Figure 10:
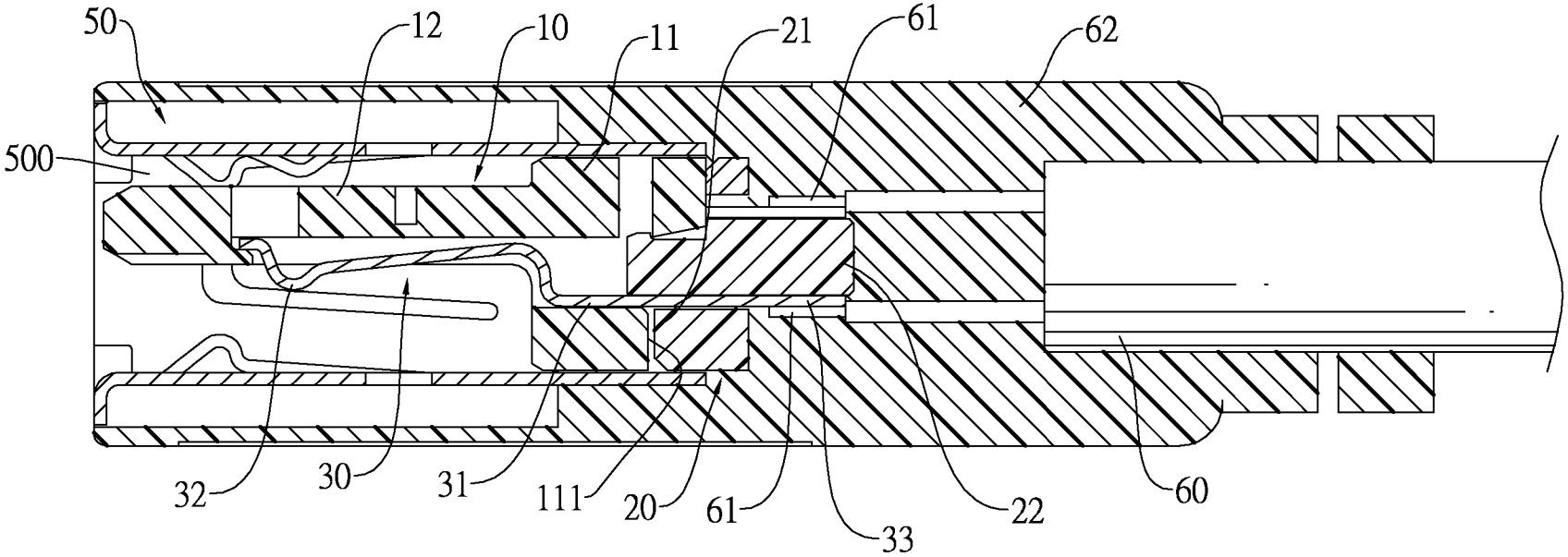
FIG. 10 is another cross sectional side view of the receptacle connector and the cable in FIG. 1.

With reference to FIGS. 1 to 3, a receptacle connector in accordance with the present invention is mounted on one end of a cable to form a high speed data transmission cable assembly. The cable has a body (60), multiple copper wires (61) and a sheath (62). The wires (61) are mounted axially in the body (60) and partially extend out of the body (60). The sheath (62) is insulating and covers the receptacle connector and wires (61).

The receptacle connector in accordance with the present invention comprises an insulating housing (10), a rear stopper (20), multiple first terminals (30), multiple second terminals (40) and a shell (50).

The insulating housing (10) has a front end (101) and a rear end (102) and may further have a base (11) and a tongue (12).

The base (11) has a front, a rear and a mounting recess (111) defined in the rear.

The tongue (12) is formed on and protrudes forward from the front of the base (11) and has a bottom.

The rear stopper (20) is mounted in the in insulating housing (10) and may have a mounting portion (21), a partition (22), multiple first positioning holes (23) and multiple second positioning holes (24). The mounting portion (21) is formed on and protrudes forward from the rear stopper (20) and is mounted in the mounting recess (111) of the base (11) of the insulating housing (10). The partition (22) is formed on and protrudes backward from the rear stopper (20). The first positioning holes (23) are defined through the rear stopper (20) under the partition (22). The second positioning holes (24) are defined through the rear stopper (20) above the partition (22).

The first terminals (30) are mounted on the insulating housing (10), are capable of implementing USB 2.0 protocol. Each first terminal (30) has a first mounting section (31), a first contacting section (32) and a first soldering cup (33).

The first mounting section (31) is mounted in the base (11) and the tongue (12) of the insulating housing (10).

The first contacting section (32) is formed on and protrudes forward from the first mounting section (31) and is mounted on the bottom of the tongue (12).

The first soldering cup (33) is longitudinal, is formed on and protrudes backward from the first mounting section (31), extends backward out of the rear end (102) of the insulating housing (10), may extend backward out of the rear of the base (11) and may extend through one of the first positioning holes (23) of the rear stopper (20) under the partition (22). The first soldering cup (33) has a U-shaped cross section and a first solder recess (331) defined therein to hold solder and one wire (61) of the cable. The first positioning holes (23) of the rear stopper (20) position the first soldering cups (33) at intervals without inadvertently contacting each other and incurring shorting problems.

The second terminals (40) are mounted on the insulating housing (10), are capable of cooperating with the first terminals (30) to implement USB 3.0 protocol. Each second terminal (40) has a second mounting section (41), a second contacting section (42) and a second soldering cup (43).

The second mounting section (41) is mounted in the base (11) and the tongue (12) of the insulating housing (10).

The second contacting section (42) is formed on and protrudes forward from the second mounting section (41) and is mounted on the bottom of the tongue (12).

The second soldering cup (43) is longitudinal, is formed on and protrudes backward from the second mounting section (41), extends backward out of the rear end (102) of the insulating housing (10), may extend backward out of the rear of the base (11) and may extend through one of the second positioning holes (24) of the rear stopper (20) above the partition (22). The second soldering cup (43) has a U-shaped cross section and a second solder recess (431) defined therein to hold solder and one wire (61) of the cable. The second positioning holes (24) of the rear stopper (20) position the second soldering cups (43) at intervals without inadvertently contacting each other and incurring shorting problems. Furthermore, the partition (22) separates the first soldering cups (33) from the second soldering cups (43) to facilitate mounting the wires (61) of the cable respectively to the first and second soldering cups (33, 43) and decreases the probability of wiring errors.

The shell (50) covers the insulating housing (10), the first terminals (30), the second terminals (40) and rear stopper (20) and has a cavity (500). The cavity (500) is defined through the shell (50), accommodates the insulating housing (10), the first terminals (30), the second terminals (40) and rear stopper (20) and has a front opening serving as a socket hole.

The receptacle connector is mounted on one end of the cable and allows cable to implement high speed data transmission based on USB 3.0 protocol. Furthermore, the first and second soldering cups (33, 43) accommodate solder and respectively hold wires (61) of the cable to allow further soldering processes so that the receptacle connector is mounted securely on the cable to form a high speed data transmission cable assembly.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A receptacle connector for a cable comprising:

an insulating housing having a front end and a rear end;

multiple first terminals mounted on the insulating housing and each first terminal having a first soldering cup formed on the first terminal and extending backward out of the rear end of the insulating housing;

multiple second terminals mounted on the insulating housing, being capable of cooperating with the first terminals to implement USB 3.0 protocol and each second terminal having a second soldering cup formed on the second terminal and extending backward out of the rear end of the insulating housing; and a shell covering the insulating housing, the first terminals and the second terminals, and having a cavity defined through the shell and having a front opening serving as a socket hole;

wherein the insulating housing further has a base having a front and a rear; and a tongue formed on and protruding forward from the front of the base;

wherein each first terminal further has a first mounting section and a first contacting section, the first mounting section is mounted in the base and the tongue, the first contacting section is formed on and protrudes forward from the first mounting section and is mounted on the bottom of the tongue, the first soldering cup of the first terminal is formed on and protrudes backward from the first mounting section;

wherein each second terminal further has a second mounting section and a second contacting section, the second mounting section is mounted in the base and the tongue, the second contacting section is formed on and protrudes forward from the second mounting section and is mounted on the bottom of the tongue, the second soldering cup of the second terminal is formed on and protrudes backward from the second mounting section;

wherein the base of the insulating housing further has a mounting recess defined in the rear; and wherein a rear stopper is mounted in the insulating housing and has a mounting portion formed on and protruding forward from the rear stopper and mounted in the mounting recess of the base of the insulating housing;

a partition formed on and protruding backward from the rear stopper and separating the first soldering cups from the second soldering cups;

multiple first positioning holes defined through the rear stopper under the partition so that the first soldering cups extend respectively through the first positioning holes and are located under the partition; and multiple second positioning holes defined through the rear stopper above the partition so that the second soldering cups extend respectively through the second positioning holes and are located above the partition.

2. The receptacle connector as claimed in claim 1, wherein each first soldering cup is longitudinal and has a U-shaped cross section.

3. The receptacle connector as claimed in claim 1, wherein each second soldering cup is longitudinal and has a U-shaped cross section.

4. The receptacle connector as claimed in claim 1, wherein the first terminals are capable of implementing USB 2.0 protocol.

5. The receptacle connector as claimed in claim 2, wherein the first terminals are capable of implementing USB 2.0 protocol.

6. The receptacle connector as claimed in claim 3, wherein the first terminals are capable of implementing USB 2.0 protocol.

* * * * *